US009194659B2

(12) United States Patent
Oglesby

(10) Patent No.: US 9,194,659 B2
(45) Date of Patent: Nov. 24, 2015

(54) MOUNT FOR A FIREARM

(71) Applicant: Paul Oglesby, Darley (GB)

(72) Inventor: Paul Oglesby, Darley (GB)

( * ) Notice: Subject to any disclaimer, the term of this patent is extended or adjusted under 35 U.S.C. 154(b) by 0 days.

(21) Appl. No.: 14/309,581

(22) Filed: Jun. 19, 2014

(65) Prior Publication Data

US 2015/0000172 A1 Jan. 1, 2015

(30) Foreign Application Priority Data

Jun. 27, 2013 (GB) ..... 1311572.0

(51) Int. Cl.
*F41G 11/00* (2006.01)

(52) U.S. Cl.
CPC ..... *F41G 11/003* (2013.01); *F41G 11/001* (2013.01)

(58) Field of Classification Search
CPC ..... F41G 11/002; F41G 11/001; F41G 1/387; F41G 11/004; F41G 11/005
USPC ..... 42/124, 125, 127, 90
See application file for complete search history.

(56) References Cited

U.S. PATENT DOCUMENTS 5,276,988 A * 1/1994 Swan ..... 42/127
7,272,904 B2 9/2007 Larue
D604,382 S * 11/2009 Swan ..... D22/108
7,739,824 B1 6/2010 Swan
7,757,422 B1 * 7/2010 Swan ..... 42/96
7,757,423 B1 7/2010 Swan
7,802,395 B1 * 9/2010 Swan ..... 42/127
7,886,476 B1 * 2/2011 Swan ..... 42/127
7,908,782 B1 * 3/2011 LaRue ..... 42/128
7,913,441 B1 * 3/2011 Reed ..... 42/124
8,112,933 B1 2/2012 Swan
8,156,679 B1 * 4/2012 Swan ..... 42/124
2006/0207156 A1 * 9/2006 Larue ..... 42/127
2010/0031553 A1 2/2010 Couture et al.
2014/0013644 A1 * 1/2014 Trapp ..... 42/90
2014/0082985 A1 * 3/2014 Larue ..... 42/90

* cited by examiner

*Primary Examiner* — Joshua Freeman

(74) *Attorney, Agent, or Firm* — Kirton McConkie; Evan R. Witt

(57) ABSTRACT

A mount for an accessory for a firearm having a Picatinny rail. The mount includes a chassis with one or more locking devices. Each locking device includes a lever that moves a plate into engagement with the Picatinny rail to clamp the mount to the rail. Each locking device also includes an actuator which not only moves the plate into engagement with the Picatinny rail but includes a self-tightening mechanism in which a nut and bolt arrangement are tightened by movement of the lever from a first position to a second position while at the same time bringing the plate into engagement with the rail. Each locking device also includes an automatic locking feature for locking the lever in position and a mechanism for preventing accidental operation of the actuator.

7 Claims, 13 Drawing Sheets

MOUNT FOR A FIREARM

The present invention relates to a mount for mounting an accessory onto a firearm.

Accessories such as sight or scope can be used with firearms. These are often mounted on the hand guard and receiver of a firearm using a so-called Picatinny rail. Picatinny rails have a number of T-shaped ridges or projections spaced regularly along the rail with spacing slots in-between. Accessories are traditionally mounted on the rail by either sliding them on from one end or the other or by means of a Weaver mount which is clamped to the rail with bolts, thumbscrews or levers. The accessory is clamped or locked in place on the Picatinny rail.

U.S. Pat. No. 7,272,904 describes an adjustable mount for a Picatinny rail clamp that includes a rotating lever clamp for clamping the accessory to the Picatinny rail.

To adjust and tighten the clamping mechanism a nut and bolt arrangement is used. A tool such as a spanner is required to tighten and loosen the nut on the bolt. The spanner tightens the bolt and increases tension and to move the lever up to tighten against the rail.

Tools are easily lost and the necessity to have one in order to adjust this mount would potentially cause issues in the field.

According to the present invention, there is provided a mount for mounting an accessory on a firearm, the firearm having a rail comprising at least one projection having an engagement surface, the mount comprising: a chassis for mounting on the rail by means of the at least one projection; an accessory retaining means on the chassis configured to retain the accessory therein; and a locking device configured to releasably engage with the at least one projection to releasably secure the mount to the rails, the locking device comprising; a lever having a handle and a plate connected thereto, the plate including an aperture and a locking surface for engagement with the engagement surface of the at least one projection, the lever being moveable between a free position in which the locking surface is disengaged from the engagement surface and an engaged position in which the locking surface engages with the engagement surface to secure the mount to the rail; a nut and bolt arrangement including a nut and a bolt, the bolt extending through the plate aperture substantially orthogonal therefrom such that the handle and plate are rotatable with respect to the bolt, and the nut configured for cooperation with the bolt for relative rotation therewith and having a plurality of recesses spaced around the outer edge of the nut; an actuator configured for slidable movement along the handle between a first position and a second position, the actuator including a lug configured for cooperation with one of the plurality of recesses such that, in the first position, the lug is clear of the recesses and in the second position cooperates with one of the plurality of recesses whereby movement of the lever between the unlocked and locked position causes the bolt to rotate to thereby tighten the nut and bolt arrangement to cause the plate to move towards the projection to clamp the plate to the projection as the engagement surface engages the locking surface.

This has the advantage of providing a self-tightening mechanism which negates the need for any additional tool.

The mount may further include an accessory retaining means on the chassis configured to retain the accessory therein.

The actuator may be biased to the first position and is configured to move to the second position in response to the application of manual force. This biasing may be provided by means of a compression spring provided with the handle.

The actuator may have an internal cavity and the compression spring acts against a wall of the cavity to bias the actuator to the first position.

The locking device may include a frame extending laterally from the chassis for supporting the nut and bolt arrangement.

The frame may include a retaining groove and the actuator includes a peg, the peg being arranged for cooperation with retaining groove to retain the actuator in the locked position.

The retaining groove may include a return portion whereby the peg is biased into the return portion as a consequence of the biasing of the actuator being biased to the first position.

The locking device may include a cup having an a plurality of lugs around the external circumference and an opening with a plurality of notches therearound for engaging with the bolt by means of a collar provided on the bolt, and the frame includes a circular aperture for receiving the cup therein and having a plurality of recesses for receiving the lugs when the cup is received therein, such that rotation of the bolt and cup is prevented and rotation of the nut with respect to the bolt causes the nut and bolt arrangement to tighten.

The bolt may have a bolt head and the plate may be secured between the bolt head and the frame.

The nut and bolt arrangement may include a spring arranged between the nut and the bolt to create tension therebetween. The spring may be a wave spring.

The actuator may include an elongate channel and the handle may have a retaining pin configured for insertion in the elongate channel to retain the actuator in place on the handle, the elongate channel being configured to facilitate movement between the first position and the second and to limit the extent of travel therebetween. The limit of travel is defined by the ends of the elongate channel The retaining pin may include an orthogonally extending switching pin rotatable between a locked position and an unlocked position such that, in the locked position, movement of the actuator between the first position and the second position is prevented. The retaining pin may rotate through 90° between the locked position and the unlocked position.

The retaining pin may have first and second notches and a detent operationally connecting the retaining pin and the compression spring to retain the retaining pin in either the locked or unlocked position.

The actuator may include a stop surface which abuts the switching pin when in the locked position. The stop surface may be defined by an L-shaped cutaway portion of the underside of the actuator.

The mount may have one or more locking devices.

The invention will now be described, by way of example only, with reference to the following drawings of which:

Figure 1:
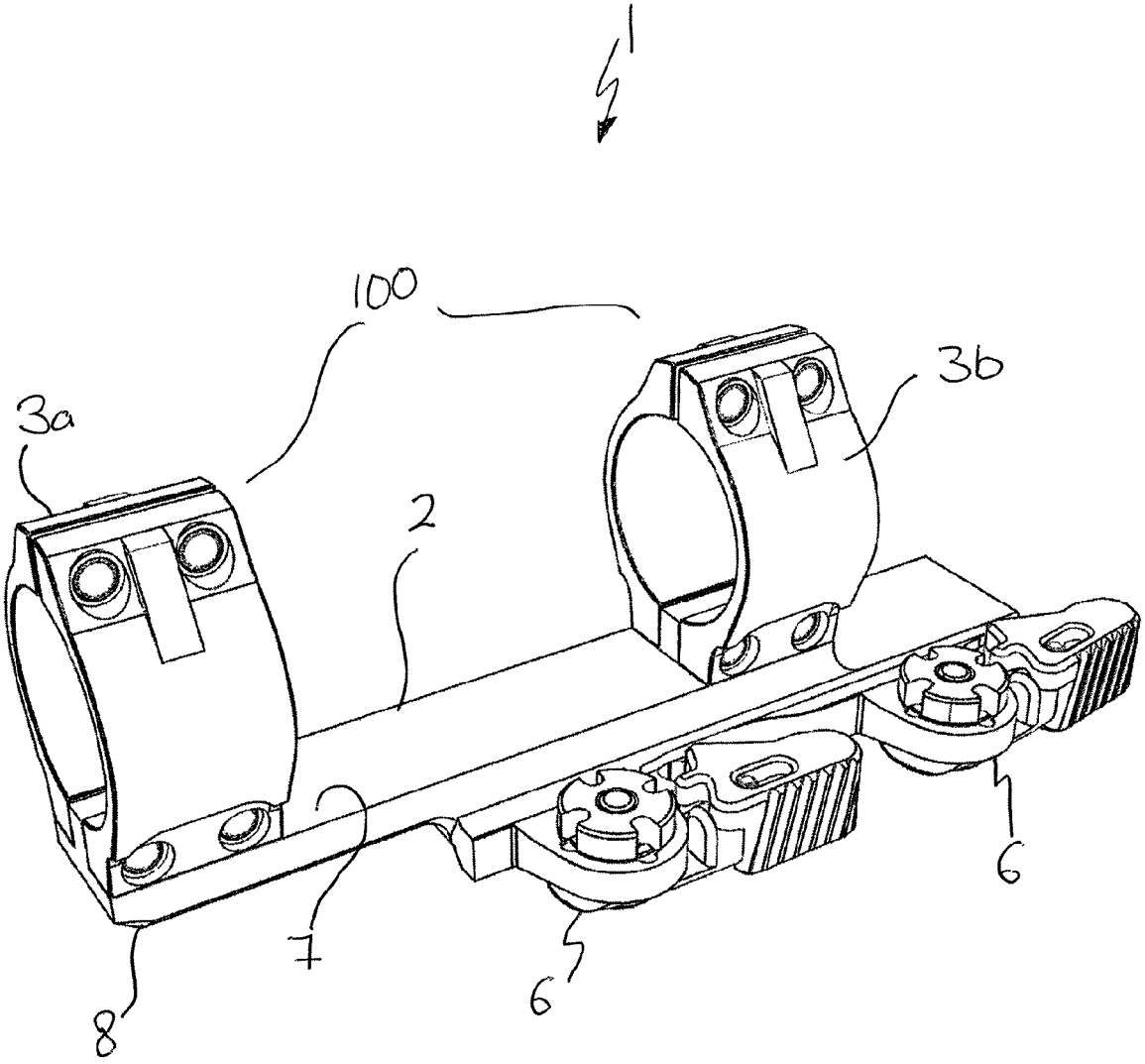
FIG. 1 is a perspective of a mount for mounting an accessory on a firearm.
Figure 3:
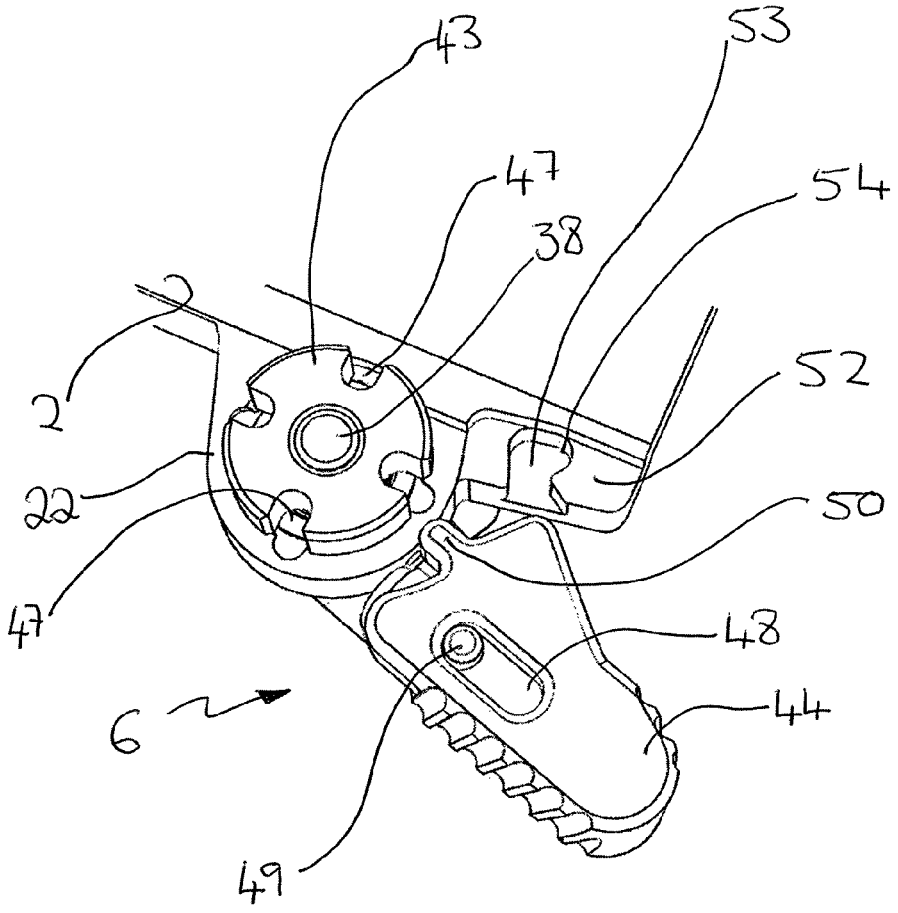
FIG. 3 is a perspective plan view of a locking device for the mount of FIG. 1.
Figure 4A:
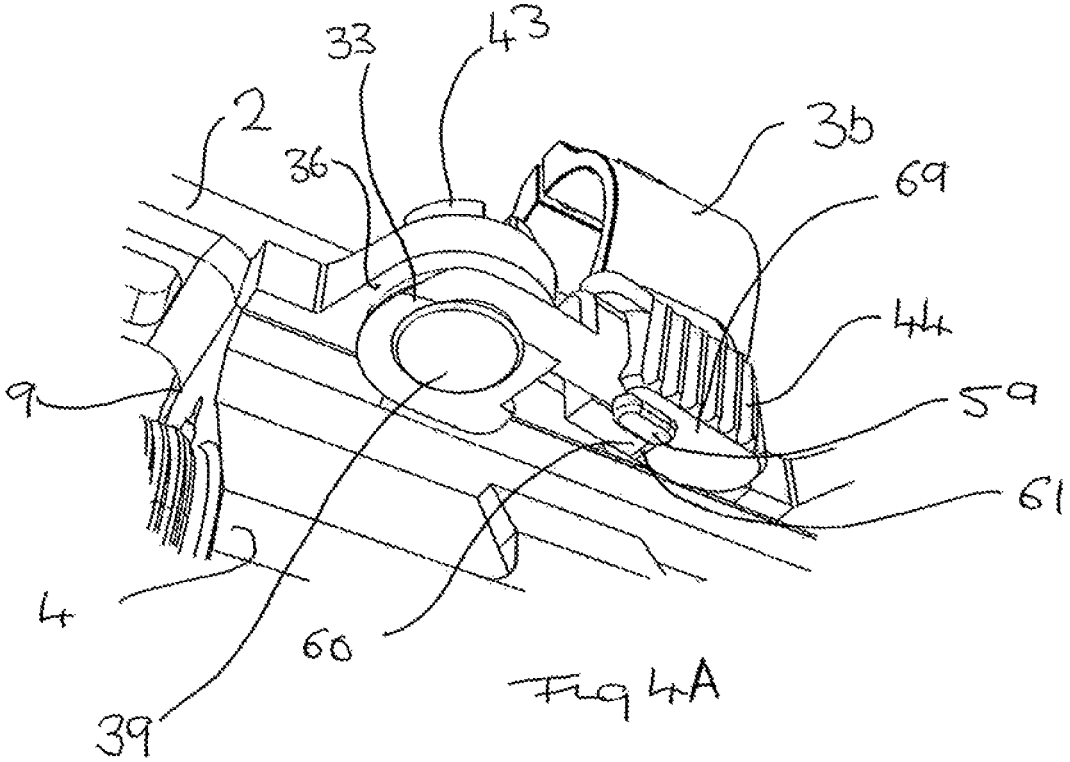
FIG. 4A is a perspective underside view of the locking device when locked onto the Picatinny rail of a firearm.
Figure 4B:
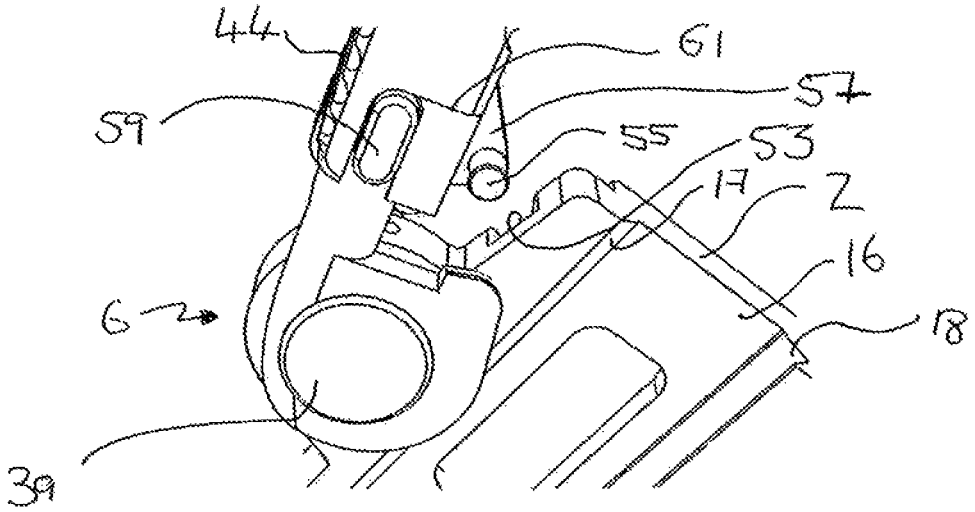
Figure 5A:
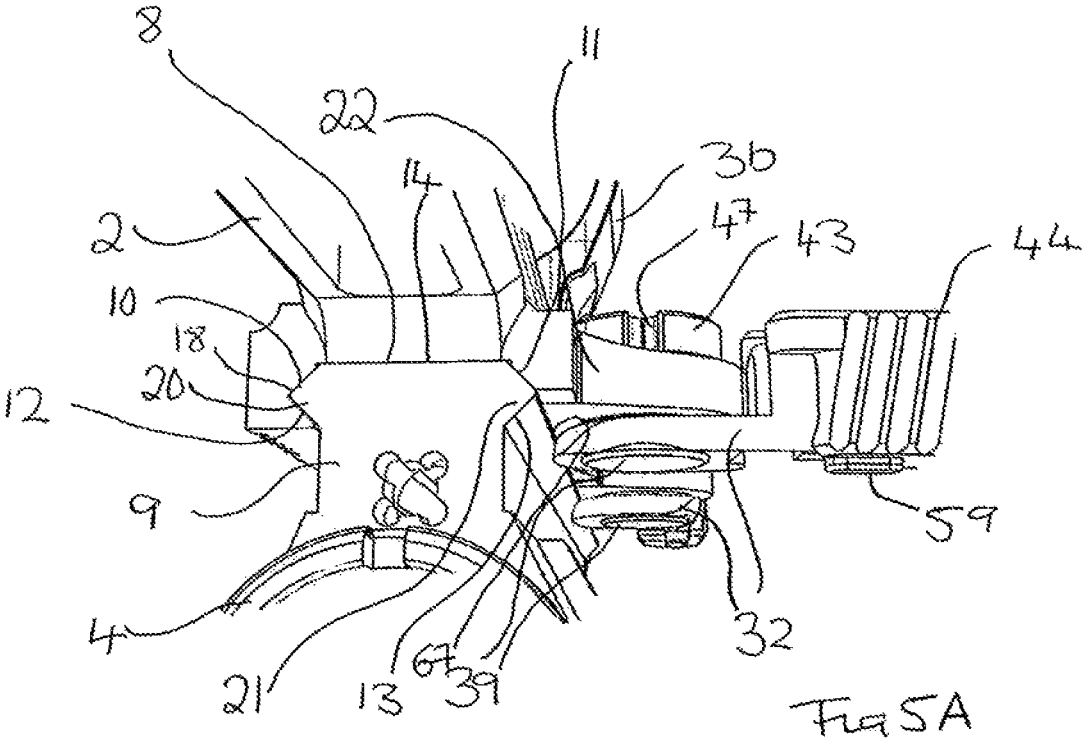
Figure 5B:
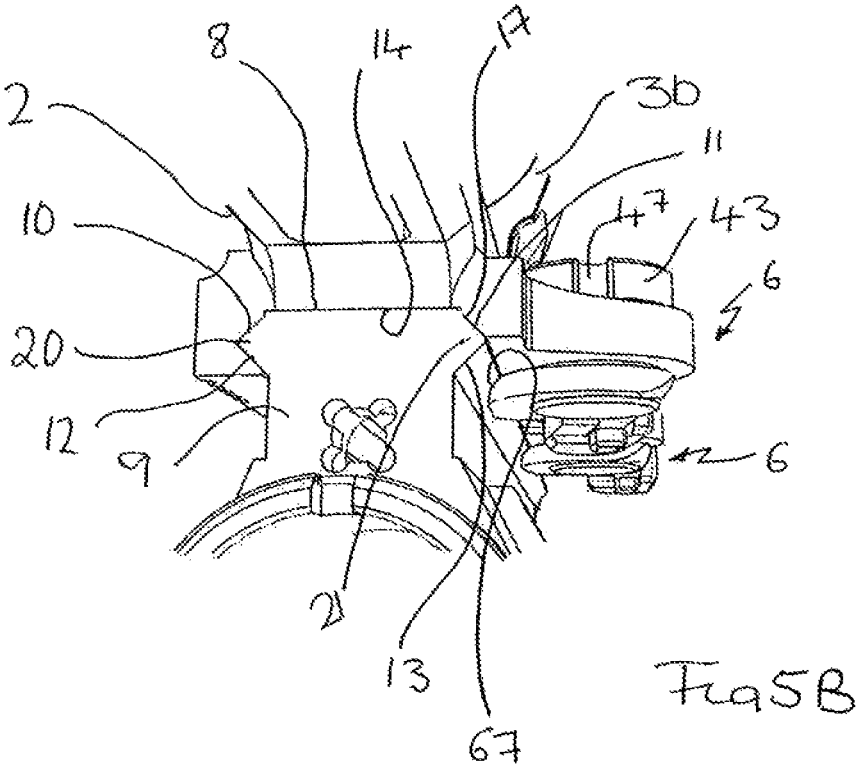
Figure 7:
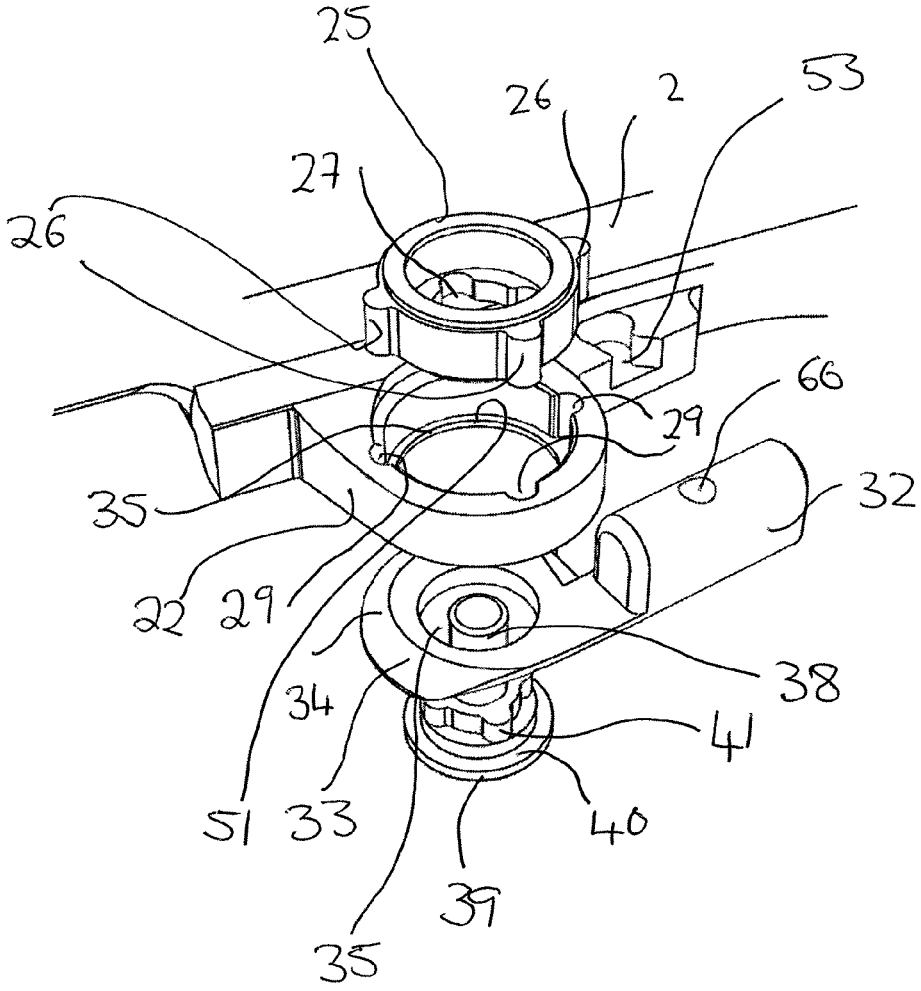
Figure 8:
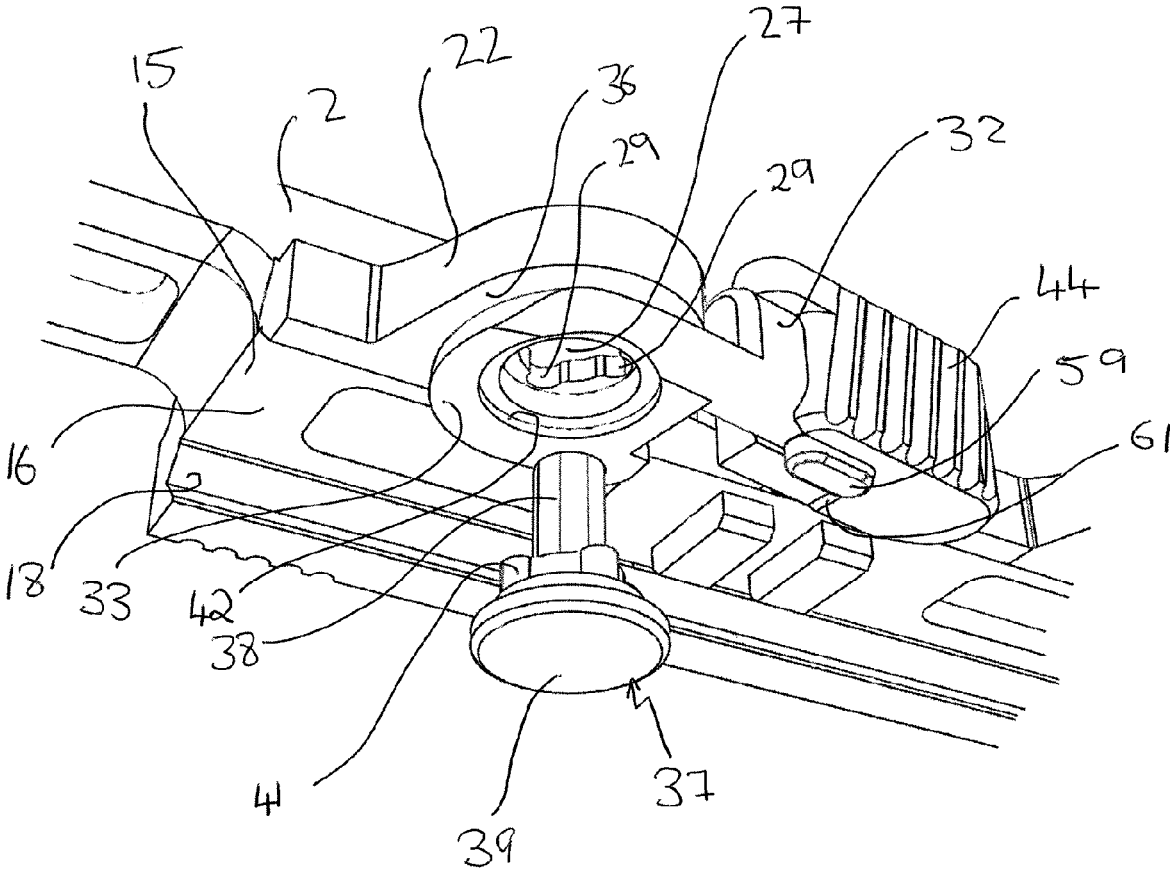
Figure 9:
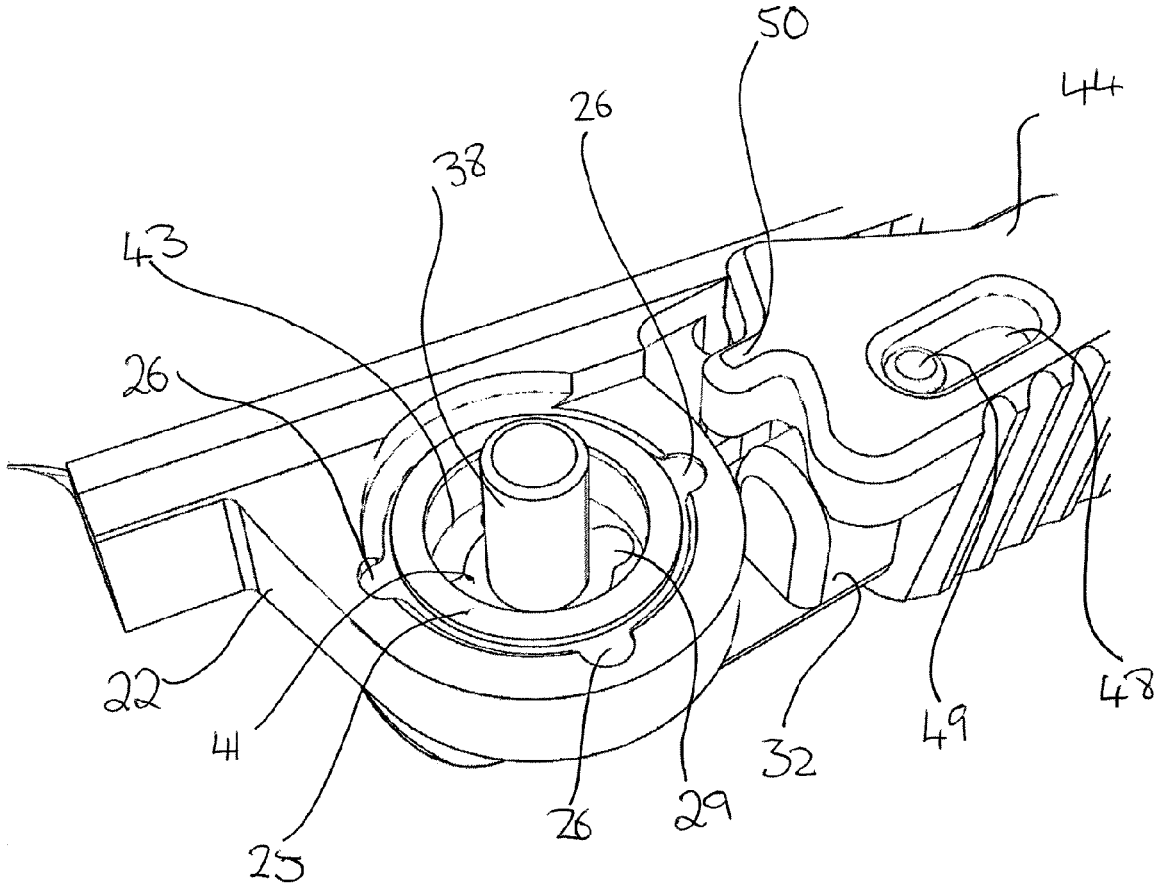
Figure 10:
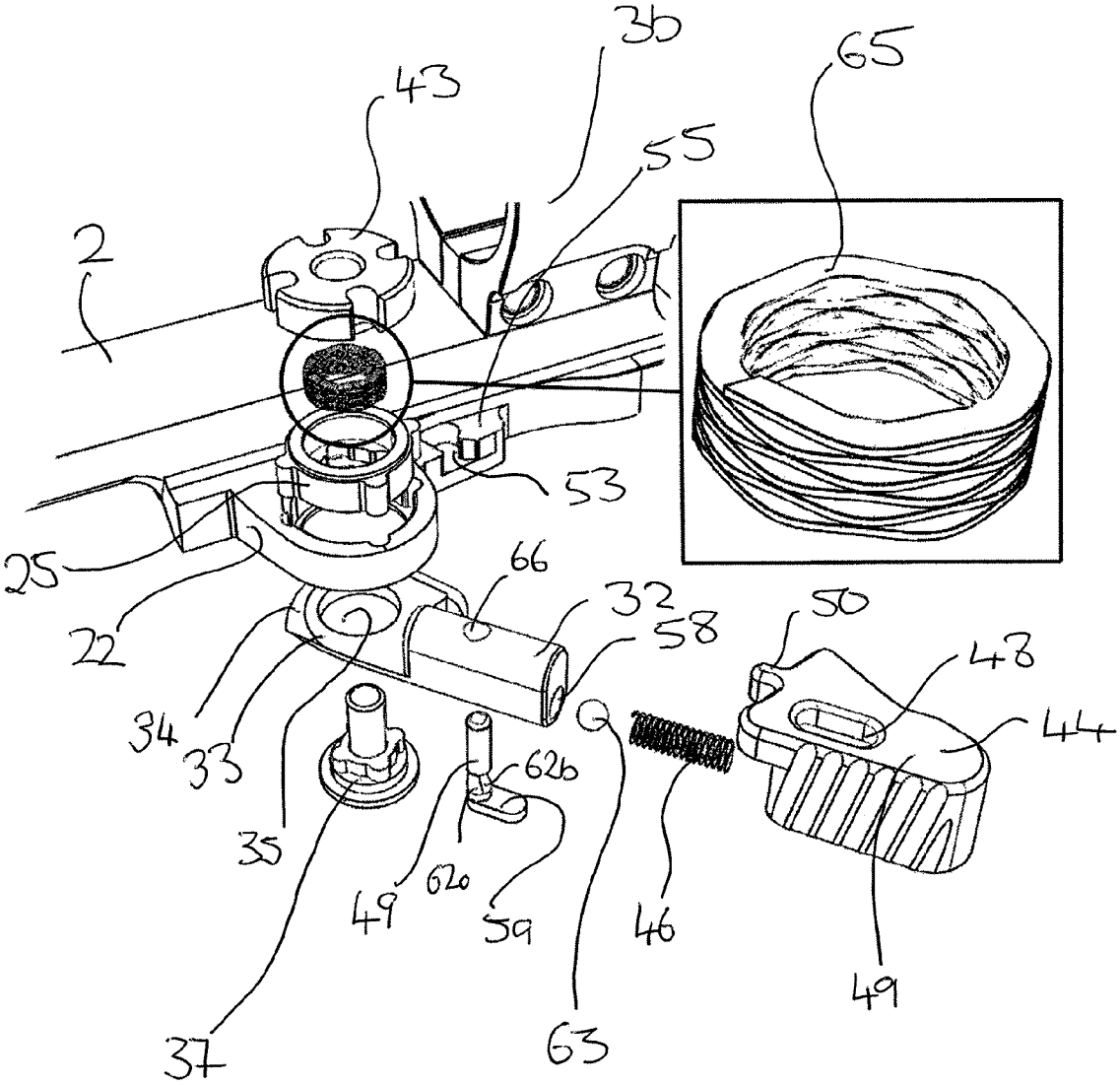
Figure 11:
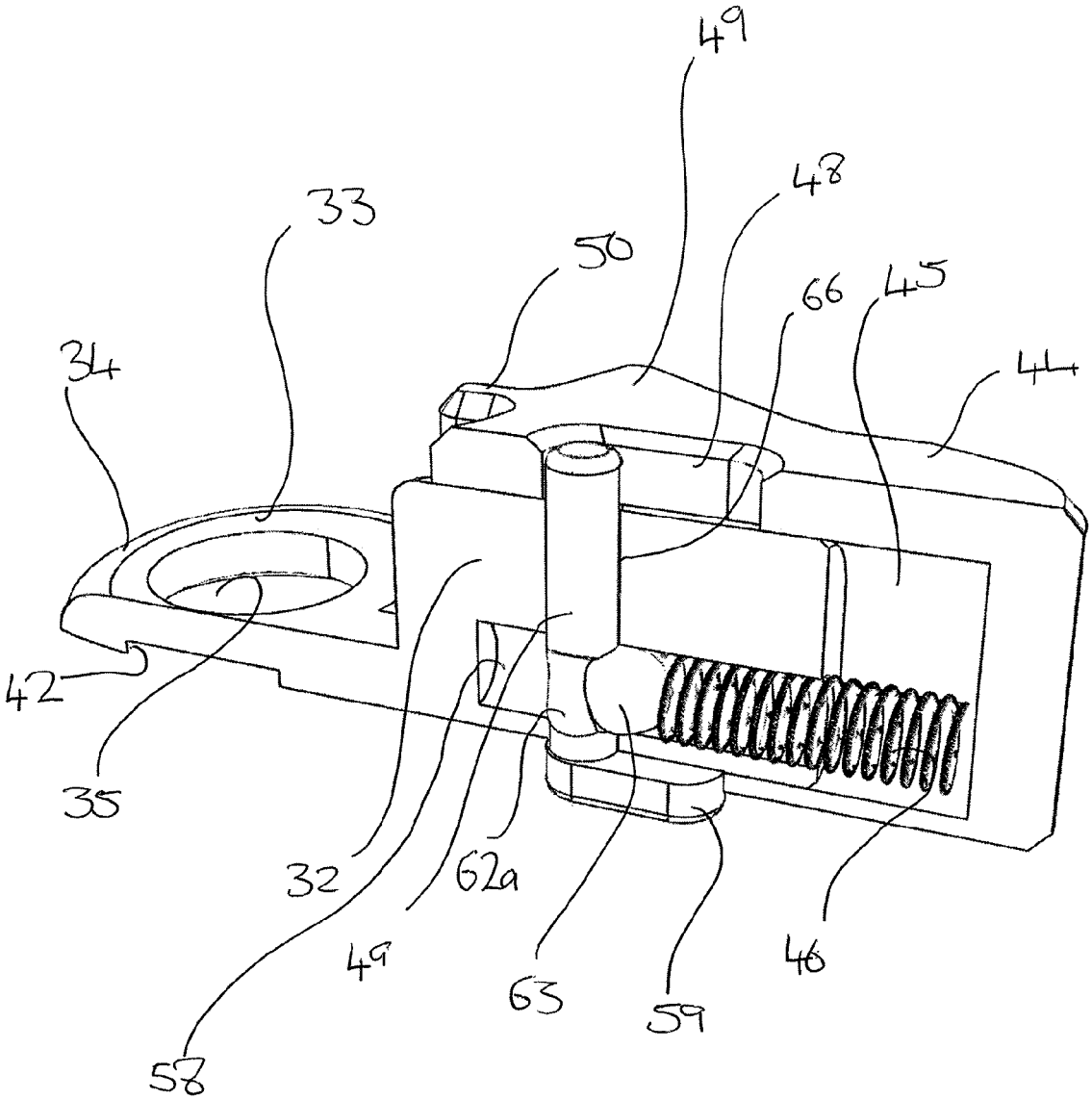
Figure 12A:
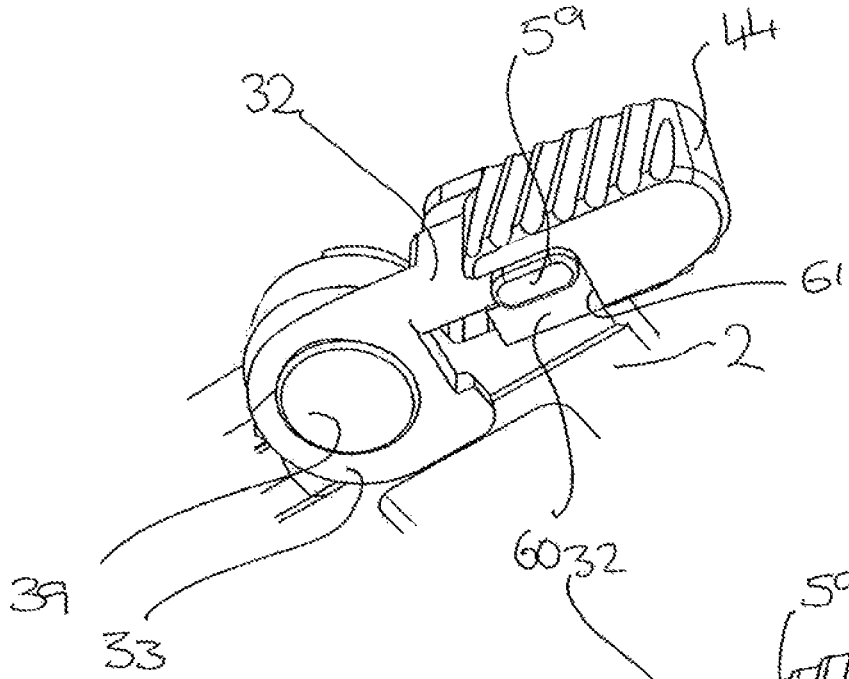
Figure 12B:
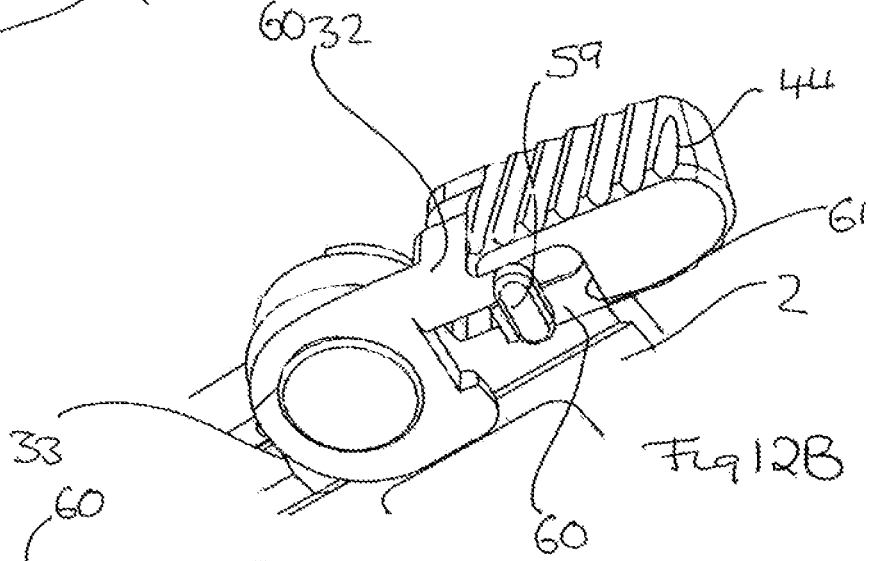
Figure 12C:
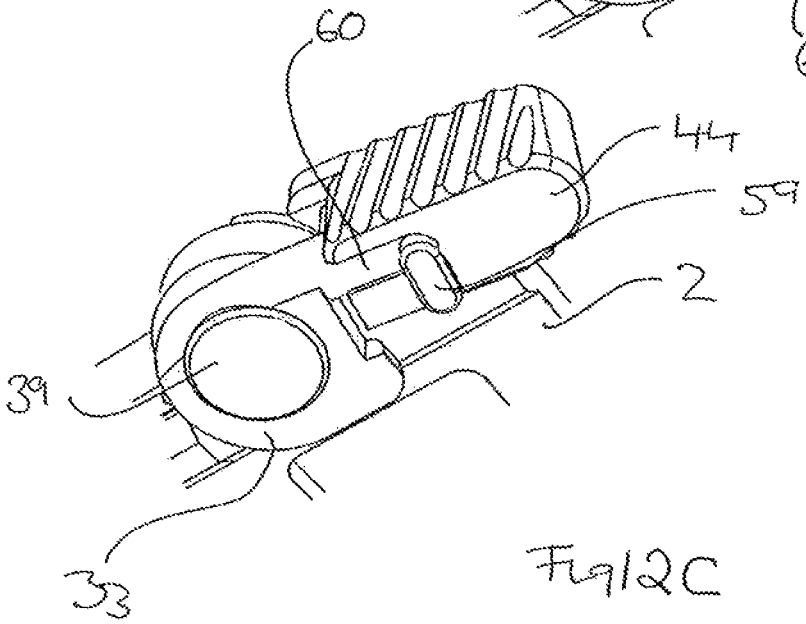

FIG. 4*b* is a second perspective underside view of the locking device for the mount of FIG. 1;

FIGS. 5A and 5B are perspective view of a portion of the mount of FIG. 1 with the locking devices in unlocked and locked positions respectively;

FIGS. 6A to 6D are perspective views of the locking device if FIG. 3 illustrating the locking and self-tightening operation of the locking device;

FIG. 7 is a first exploded view of the locking device of FIG. 3 showing some of the components of the locking device;

FIG. 8 is a first detailed view of the locking device of FIG. 3 when assembled;

FIG. 9 is a second detailed view of the locking device of FIG. 3;

FIG. 10 is a second exploded view of the locking device of FIG. 3 showing some of the components of the locking device;

FIG. 11 shows the locking device with a retaining pin detail;

FIGS. 12A to 12C illustrate the mechanism for locking the actuator of the looking device; and FIGS. 13A to 13D illustrate the steps of mounting of the mount of FIG. 1 on the firearm.

A mount 1 for mounting an accessory on a firearm 4 comprises a chassis 2 upon which is provided an accessory retaining means 100. The chassis 2 is used to mount the mount 1 on a Picatinny rail 5 (hereinafter referred to as "rail") provided on the firearm 4. The use and form of Picatinny rails is well known to persons skilled in the art and need not be described in any further detail herein.

In the embodiment described herein, the mount 1 is for a riflescope. The accessory retaining means in this example comprises two split-rings 3*a*, 3*b* spaced apart along the chassis 2 and through which the riflescope is inserted and retained. The structure and arrangement of the accessory retaining means 100 will vary depending upon the accessory to be mounted on the firearm 4. In so far as it is not relevant to the present invention, the structure and form of the accessory retaining means 100 will not be described in any further detail herein.

Figure 2:
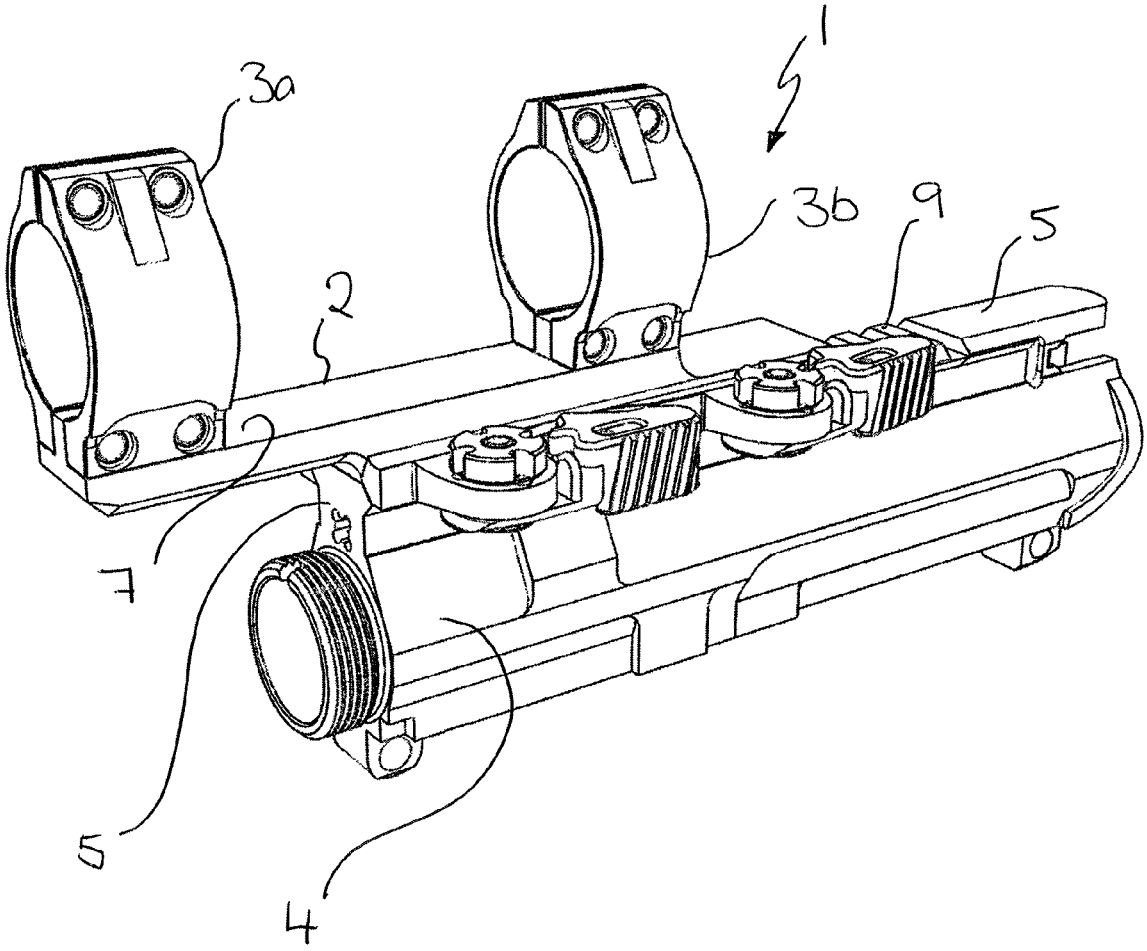
FIG. 2 is a perspective view of the mount of FIG. 1 mounted on a firearm.

FIG. 2 illustrates a mount 1 mounted to an upper receiver of a firearm 4 with a built-in rail 5.

One or more locking devices 6 extend from the chassis 2 for securing the mount 1 onto the rail 5.

The number of locking devices 6 required will depend upon the mount 1 and the accessory for which it is designed. In this embodiment, two locking devices 6 are shown. Each locking device 6 is identical.

The chassis 2 is an elongate slat with an upper surface 7 and an underside surface 8. The split rings 3*a*, 3*b* are spaced along the upper surface 7 and the underside surface 8 is configured to engage with the rail 5.

As is well known, the rail 5 has a number of projections 9 spaced along the rail 5, each projection 9 having a number of engagement surfaces 10, 11, 12, 13. FIGS. 5A and 5B, show first and second angled upper engagement surfaces 10, 11 and corresponding first and second angled lower engagement surfaces 12, 13. Each projection 9 also has an upper face 14. The upper and lower engagement surfaces 10, 12; 11, 13 define V-shaped projections 20, 21 extending laterally from the upper face 14.

The underside surface 8 of the chassis 2 has a mounting portion 15 which is configured to define a longitudinal channel 16, the sides of which are an inclined surface 17 and a V-shaped notch 18, which are configured to engage with the respective V-shaped projections 20, 21 of the rail projection 9. The chassis 2 is mounted onto the rail 5 as will be described in further detail below.

Provided at the mounting portion 15 and extending laterally therefrom are two of the locking devices 6 extending laterally from the chassis 2. As mentioned above, two locking devices 6 are used but more or fewer can be used depending upon the accessory to be mounted.

Each locking device 6 comprises a frame 22 extending laterally from the chassis 2 and formed integrally with the mounting portion 15. The frame 22 defines a substantially circular aperture 23 with three spaced recesses 30 around the circumference of the aperture 23. The circular aperture 23 has an inwardly extending annular lip 51 at its base, to retain a cylindrical cup 25 therein. The frame 22 also includes an extending surface 52 adjacent the circular aperture 23 into which a retaining groove 53 is formed. The retaining groove 53 includes a return portion 54.

The cylindrical cup 25 has three lugs 26 provided around the external circumference 27 of the cylindrical cup 25, each lug 26 being shaped and configured so that it can be inserted into the circular aperture 23 with the lugs 26 being received into corresponding recesses 30 in the frame 22. The inwardly extending annular lip 51 serves to retain the cylindrical cup 25 within the circular aperture 23.

The cylindrical cup 25 has an opening 27 in the base 28 of the cylindrical cup 25. The opening 27 is generally circular in shape with four equidistantly-spaced notches 29 therearound.

The locking device 6 has a lever 31 that comprises a handle 32 with a plate 33 connected thereto. The plate 33 includes a curved outer edge portion 34 and has a circular aperture 35. The curved outer edge portion 34 provides a locking surface 67 for engagement with the lower engagement surface 13 of the projections 9 of the rail 5 so as to securely clamp the mount 1 to the rail 5 by clamping between the locking surface 67 and the inclined surface 17 on the chassis 2.

The circular aperture 35 is located eccentrically within the plate 33 such that the radial distance between the centre of the circular aperture 35 and the curved outer edge portion 34 of the plate 33 is variable i.e. not constant.

The plate 33 is retained against the underside 36 of the frame 22 by means of a nut and bolt arrangement. The nut and bolt arrangement comprises a nut 43 and a bolt 37. The bolt 37 comprises a threaded shaft 38 with a bolt head 39. The bolt head 39 is circular with an outer edge 40 having a stepped profile. The threaded shaft 38 has a collar 41 at the base adjacent the bolt head 39. The collar 41 has a profile that matches the shape of the opening 27. This is shown in FIGS. 7 and 8.

The edge 42 of the circular aperture 35 in the plate 33 also has a stepped profile that cooperates with the stepped profile of the outer edge 40 of the bolt head 39. This is shown in FIG. 9.

When assembled, the cylindrical cup 25 is inserted into the circular aperture 23, resting on the inwardly extending annular lip 51 with the lugs 26 being received in the corresponding recesses 30 of the frame 22. The plate 33 is retained against the underside 36 of the frame 22 by means of the bolt 37 which is inserted through the circular aperture 35 in the plate 33 and through the opening 27 in the base of the cylindrical cup 25 such that the collar 41 engages with the cylindrical cup 25 by means of the cooperating shapes of the collar 41 and the opening 27. The outer edge 40 of the bolt head 39 cooperates with the edge 42 of the circular aperture 35. This is shown particularly in FIG. 8.

A wave spring 65 is inserted in the annular space 43 between the bolt shaft 38 and the cylindrical cup 25. This is shown in FIG. 10.

The nut 43 is threaded on to the bolt shaft 38. The nut 43 is cylindrical in shape and has four recesses 47 provided substantially equidistantly around the external circumference of the nut 43.

The lever 31 includes an actuator 44 in the form of a knob which is slidably received over the handle 32 for relative movement thereto.

The actuator 44 has an internal cavity 45 into which the handle 32 is inserted so that the actuator 44 can slide along the handle 32 between a first position and a second position. In the first position the actuator 44 is in a position disengaged from the nut 43 and, in the second position the actuator 44 is engaged with the nut 43 as will be described in further detail below. The actuator 44 also has an elongate channel 48 provided in an upper face 49 of the actuator 44. The handle 32 has a compression spring 46 provided longitudinally therein in a first bore 58 running lengthways through the handle 32. The compression spring 46 acts against the back wall 68 of the internal cavity 45 and so biases the actuator 44 towards the first position. The direction of this bias is indicated by the arrow A in FIG. 12

A retaining pin 49 extends through a second bore 66 running through the handle 32 in a direction orthogonal to the longitudinal axis of the handle 32. First and second ends of the retaining pin 49 extend beyond the second bore 66 outside the handle 32. The first end of the retaining pin 49 is configured to be inserted in the elongate channel 48 to retain the actuator 44 in place on the handle 32. The elongate shape of the channel allows the actuator 44 to slide between the first position and the second position while limiting the extent of the travel between the first position and the second position as the retaining pin 49 abuts the end regions of the elongate channel 48.

The second end of the retaining pin 49 has an extending switching pin 59 fixed thereto and which extends externally of the handle 32 in a direction orthogonal to longitudinal axis of the retaining pin 49. The retaining pin 49 is rotatable about its longitudinal axis. The underside 69 of the actuator 44 has an L-shaped cutaway portion 60 which defines a stop surface 61 for the switching pin 59. Internally of the handle 32, the retaining pin 49 has two notches 62*a*, 62*b* at right angles to one another adjacent the switching pin 59. The compression spring 46 acts upon a ball bearing detent 63 which is configured to engage the retaining pin 49 in the notches 62*a*, 62*b*. This retains the retaining pin 49 and the switching pin 59 in place. The two notches 62*a*, 62*b* on the retaining pin 49 allow the retaining pin 49 to be rotated through 90 degrees between a locked and an unlocked position. In the locked position, the retaining pin 49 is in a first orientation in which the switching pin 59 runs along the underside of the handle 32 and abuts the stop surface 61 provided on the actuator 44. This stops the actuator 44 from being able to be pushed forward. When the switching pin 59 is rotated through 90 degrees to an unlocked position, the switching pin 59 is free of the stop surface 61, thereby unlocking the actuator 44 and allows it to move freely. This is illustrated by the double-headed arrow in FIG. 12. The two notches 62*a*, 62*b* on the retaining pin 49, the ball bearing detent 63 and the compression spring 46 enable the switching pin 59 to 'click' from one position to another and stay fixed in position.

The actuator 44 also includes a finger 50 extending from the upper face 49 of the actuator 44 at the end of the actuator 44 proximal to the frame 22. The finger 50 is shaped and configured to cooperate with the recesses 47 provided in the nut 43 as will be described in further detail below.

A peg 55 extends orthogonally from the underside 57 of the upper face 49 of the actuator 44 at a position adjacent the chassis 2. This is shown in FIG. 4B. The peg 55 engages with the retaining groove 53 on the extending surface 52.

Operation of the locking device 6 will now be described.

Figure 13A:
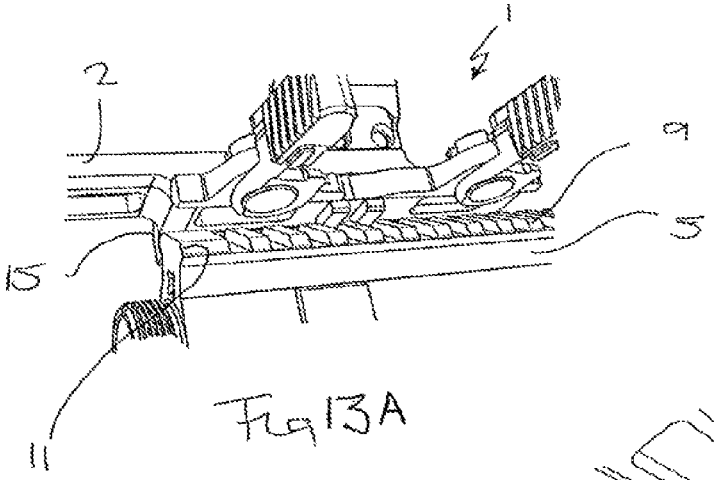
Figure 13B:
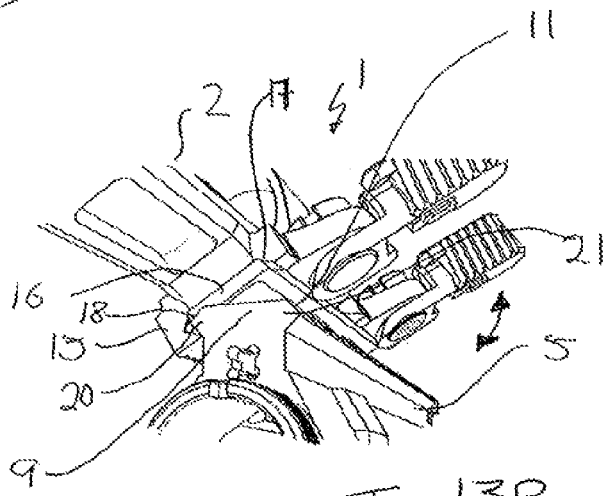
Figure 13C:
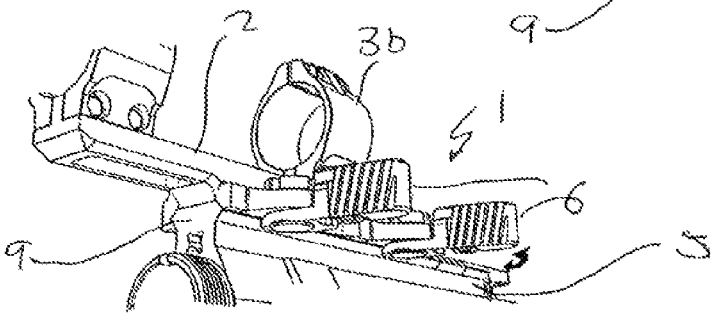

Firstly, the actuator 44 must be in an unlocked state so that it can be manually moved between the first position and the second position. As such, the retaining pin 49 needs to be in the unlocked position. This is shown in FIGS. 13B and 13C. In the unlocked position, the actuator 44 can move as indicated by the double-headed arrows in FIGS. 13B and 13C.

The chassis 2 is mounted onto the rail 5 by hooking the chassis over the rail 5 by engaging the V-shaped notch 18 with the respective V-shaped projection 20 of the rail projection 9. The other side of the chassis 2 is then brought into contact with the rail 5 so that the inclined surface 17 engages with the respective upper engagement surface 11—see FIGS. 13A and 13B.

Figure 13D:
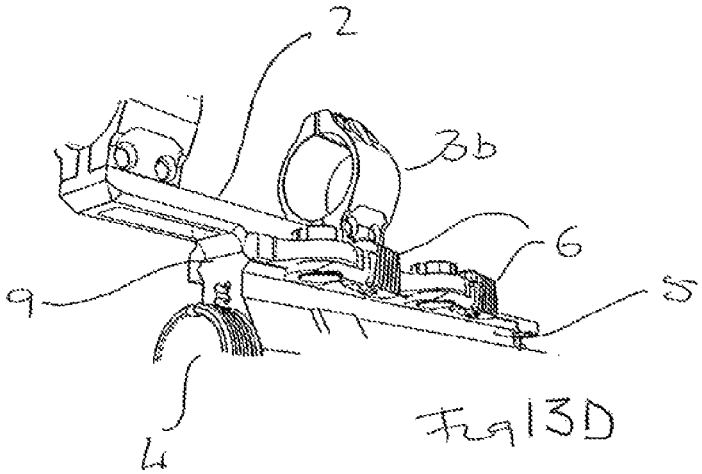

The lever 31 is manually operable to pivot from a free position in which the locking surface 67 is disengaged from the engagement surface 13 of the projections 9 on the rail 5 to an engaged position in which the locking surface 67 engages with the engagement surface 13. FIG. 13C shows the mount 1 mounted on the rail with the levers 31 of the locking devices 6 in the free position, while FIG. 13D shows the levers 31 of the locking devices 6 in the engaged position.

The construction of lever 31 is such that, because the bolt 37 is engaged within the cylindrical cup 25, the bolt 37 cannot rotate but is only able to translate in the direction of the longitudinal axis of the bolt shaft 38. The cylindrical cup 25 is also engaged in the frame 22 so that the cylindrical cup 25 is retained in place and is not able to rotate. Thus, the only part of the locking device 6 that can rotate is the lever 31 the plate 33 of which is retained between the bolt 37 and the bottom of the cylindrical cup 25, and which pivots or rotates around the longitudinal axis 56 the bolt shaft 38. Because the circular aperture 35 in the plate 33 is located eccentrically, the distance from the pivot axis 56 of the lever 3 to the curved out edge portion 34 varies. When in the engaged position the radial distance from the pivot axis 56 of the bolt shaft 38 to the curved outer edge portion 34 is such that that the locking surface 67 engages with the lower engagement surface 13, whereas, when in the free position, the radial distance is smaller so that the plate 33 cannot contact the lower engagement surface 13.

To securely clamp the mount 1 to the rail 5, the locking surface 67 needs to be brought into engagement with the lower engagement surface 13 and tightened thereon. The mount 1 is thereby clamped onto one of the V-shaped projections 21 i.e. between the lower engagement surface 13 and the inclined surface 17 of the mounting portion 15 of the chassis 2. This is shown in FIG. 5B. This is done by tightening the nut 43 on the bolt 37. The wave spring 42 creates tension between the nut 43 and the bottom of the cylindrical cup 25 and thus between the nut 43 and the bolt 37. Tightening the nut 43 draws the bolt 37 and therefore the lever 31 upwards causing more pressure to be exerted on the rail and therefore clamping the chassis 2 to the rail 5. In the embodiment described herein, the nut 43 tightens left handed so must be rotated anti clockwise.

Figure 6A:
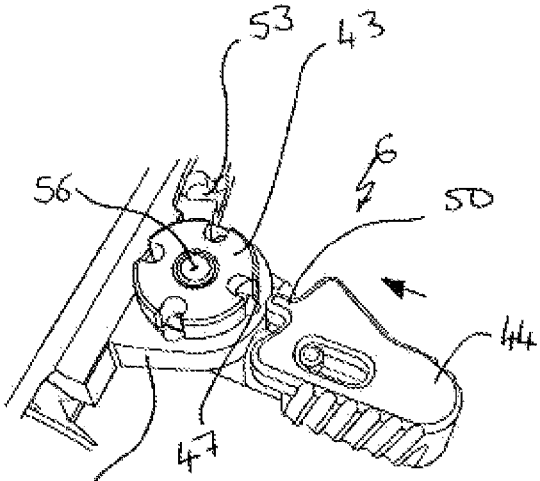
Figure 6B:
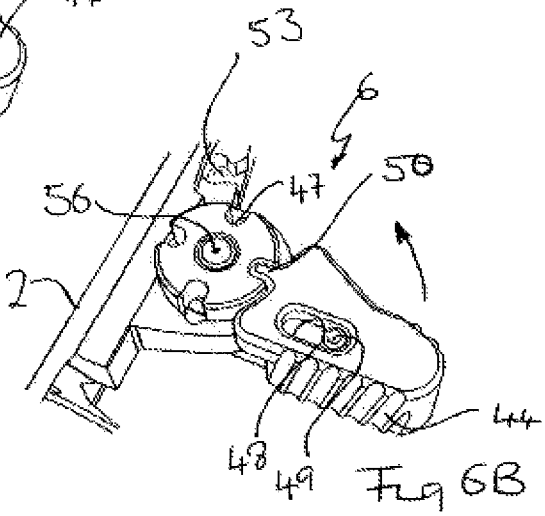
Figure 6C:
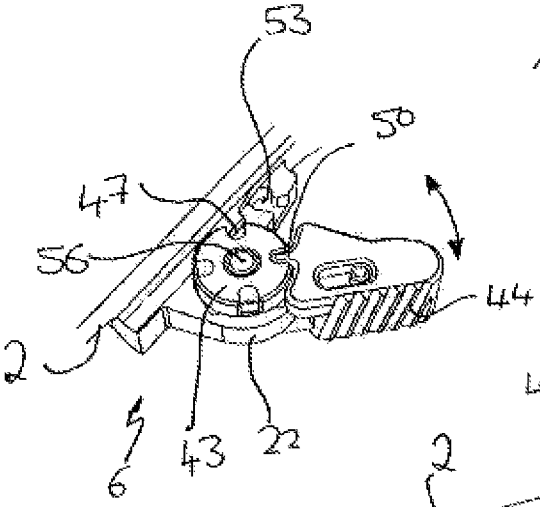
Figure 6D:
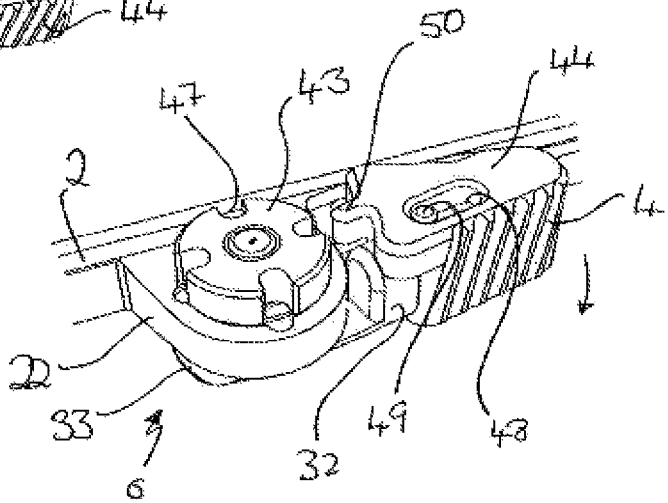

To tighten the nut 43, while moving the locking surface 67 into engagement with the lower engagement surface 13, the spring-biased actuator 44 is pushed forward along the handle 32, by applying manual forward force, so that the finger 50 slots into one of the recesses 47 on the nut 43 thus engaging the nut 43 with the actuator 44. FIG. 6A shows the actuator 44 before it is moved from the first position in which it is free of the recesses 47 on the nut 43 and FIG. 6B shows the finger 50 engaged with one of the recesses 47 on the nut 43. When so engaged the lever 31 can then be pivoted towards the chassis 2 as indicated by the arrows in FIGS. 6A to 6D which will, in turn, cause the nut 43 to rotate and thus tighten the bolt 37. This draws the locking surface 67 of the plate 33 further against the engagement surface 13. If after, this action, the locking surface 67 is not sufficiently engaged with the lower engagement surface 13 to securely clamp the mount 1 to the rail 5, the process can be repeated by removing the manual forward force on the actuator 44 so that the force of the compression spring 46 cause the actuator 44 to move backwards into the first position, thus disengaging the finger 50 from the recess 47. The lever 31 is manually rotated back to the original, free position, manually pushed forward until the finger 50 once more engages the next recess 47, rotated towards the chassis 2 to thereby tighten the bolt 37 further, and bring the locking surface into engagement with the engagement surface 13, and so on. This can be done until enough tension is created for the mount 1 to be clamped onto the rail. The rotation can be reversed to loosen the nut 43 and release tension.

In order to retain the lever 31 in the engaged position, the peg 55 extending from the underside 57 of the upper face 49 of the actuator 44 slides into the retaining groove 53 and the return portion 54 for cooperation therewith. As the lever 31 is rotated to the engaged position, because the actuator 44 is biased by the compression spring 46 to the first position in which it is distant from the plate, the peg 55 automatically clicks into the return portion 54 of the retaining groove 53 and locks the lever 31 in place. The actuator 44 must then be manually pushed forward against the force of the compression spring 46 to disengage the peg 55 from the return portion 54 of the retaining groove 53 before the lever 31 can be rotated into the unlocked position. This provides an autolock feature as the lever 31 cannot rotate closed completely without the peg 55 registering and locking with the return portion 54 of the retaining groove 53.

In order for the actuator 44 to be prevented from moving along the handle 32 (and therefore potentially unlocking the lever 31), the switching pin 59 is moved through 90° to engage the stop surface 61.

The invention claimed is:

1. A mount for mounting an accessory on a firearm, the firearm having a rail comprising at least one projection having an engagement surface, the mount comprising:

a chassis for mounting on the rail by means of the at least one projection; and a locking device configured to releasably engage with the at least one projection to releasably secure the mount to the rail, the locking device comprising;

a lever having a handle and a plate connected thereto, the plate including an aperture and a locking surface for engagement with the engagement surface of the at least one projection, the lever being moveable between an unlocked position in which the locking surface is disengaged from the engagement surface and a locked position in which the locking surface engages with the engagement surface to secure the mount to the rail;

a nut and bolt arrangement including a nut and a bolt, the bolt extending through the plate aperture substantially orthogonal therefrom such that the handle and plate are rotatable with respect to the bolt, and the nut configured for cooperation with the bolt for relative rotation therewith and having a plurality of recesses spaced around an outer edge of the nut;

an actuator configured for slidable movement along the handle between a first position and a second position, the actuator including a lug configured for cooperation with one of the plurality of recesses such that, in the first position, the lug is clear of the recesses and in the second position cooperates with one of the plurality of recesses whereby movement of the lever between the unlocked and locked position causes the bolt to rotate to thereby tighten the nut and bolt arrangement to cause the plate to move towards the at least one projection to clamp the plate to the at least one projection as the engagement surface engages the locking surface;

a frame extending laterally from the chassis for supporting the nut and bolt arrangement; and wherein the locking device includes a cup having a plurality of lugs around an external circumference and an opening with a plurality of notches therearound for engaging with the bolt by means of a collar provided on the bolt, and the frame includes a circular aperture for receiving the cup therein and having a plurality of recesses for receiving the lugs when the cup is received therein, such that rotation of the bolt and cup is prevented and rotation of the nut with respect to the bolt causes the nut and bolt arrangement to tighten.

2. A mount according to claim 1, wherein the actuator is biased to the first position and is configured to move to the second position in response to the application of manual force.

3. A mount according to claim 1, wherein the frame includes a retaining groove and the actuator includes a peg, the peg being arranged for cooperation with retaining groove to retain the actuator in the locked position.

4. A mount according to claim 1, wherein the nut and bolt arrangement includes a spring arranged between the nut and the bolt to create tension therebetween.

5. A mount according to claim 1, wherein the actuator includes an elongate channel and the handle has a retaining pin configured for insertion in the elongate channel to retain the actuator in place on the handle, the elongate channel being configured to facilitate movement between the first position and the second and to limit the extent of travel therebetween.

6. A mount according to claim 5, wherein the retaining pin includes an orthogonally extending switching pin rotatable between a locked position and an unlocked position such that, in the locked position, movement of the actuator between the first position and the second position is prevented.

7. A mount according to claim 6, wherein the actuator includes a stop surface which abuts the switching pin when in the locked position.

* * * * *